United States Patent [19]

Takeda et al.

[11] Patent Number: 4,649,383

[45] Date of Patent: Mar. 10, 1987

[54] METHOD OF DRIVING LIQUID CRYSTAL DISPLAY DEVICE

[75] Inventors: Makoto Takeda; Keisaku Nonomura; Fumiaki Funada, all of Nara, Japan

[73] Assignee: Sharp Kabushiki Kaisha, Osaka, Japan

[21] Appl. No.: 566,795

[22] Filed: Dec. 29, 1983

[30] Foreign Application Priority Data

Dec. 29, 1982 [JP] Japan ..... 57-230978

[51] Int. Cl.[4] ..... G09G 3/00

[52] U.S. Cl. ..... 340/805; 340/784

[58] Field of Search ..... 340/718, 719, 784, 805, 340/713; 350/332, 333

[56] References Cited

U.S. PATENT DOCUMENTS

| | | | |
|---|---|---|---|
| 4,236,155 | 11/1980 | Nagata | 340/805 X |
| 4,237,456 | 12/1980 | Kanatani | 340/719 |
| 4,338,598 | 7/1982 | Ohba et al. | 340/713 |
| 4,356,483 | 10/1982 | Fujita et al. | 340/805 |
| 4,408,201 | 10/1983 | Harada | 340/805 X |
| 4,413,256 | 11/1983 | Yasuda et al. | 340/805 X |
| 4,415,892 | 11/1983 | Marentic | 340/805 X |
| 4,429,304 | 1/1984 | Fujita | 340/805 X |
| 4,447,812 | 5/1984 | Suneda et al. | 340/718 X |
| 4,476,466 | 10/1984 | Mitani et al. | 340/805 |

*Primary Examiner*—Marshall M. Curtis
*Assistant Examiner*—Vincent P. Kovalick
*Attorney, Agent, or Firm*—Staas & Halsey

[57] ABSTRACT

A method of driving a matrix type liquid crystal display device which compensates for the distortion of scanning signal and data waveforms caused by resistance and capacitance of the display device electrodes. In one embodiment of this method the timing of the scanning signal is advanced with respect to the timing of the data switching signal by a time determined by the resistor-capacitor time constant of the electrodes and display elements. In another embodiment of this method the switching timing of the scanning signal is delayed with respect to the leading edge of the data signal and the switching timing of the scanning signal is advanced with respect to the trailing edge of the data signal. The delay of the leading edge and the advance of the trailing edge are determined by the resistor-capacitor time constant of the electrode and display elements and the capacitance of the display element, respectively.

10 Claims, 28 Drawing Figures

FIG. 3(a)
(PRIOR ART)
FIG. 3(b)
(PRIOR ART)
FIG. 3(c)
(PRIOR ART)
FIG. 3(d)
(PRIOR ART)
FIG. 3(e)
(PRIOR ART)
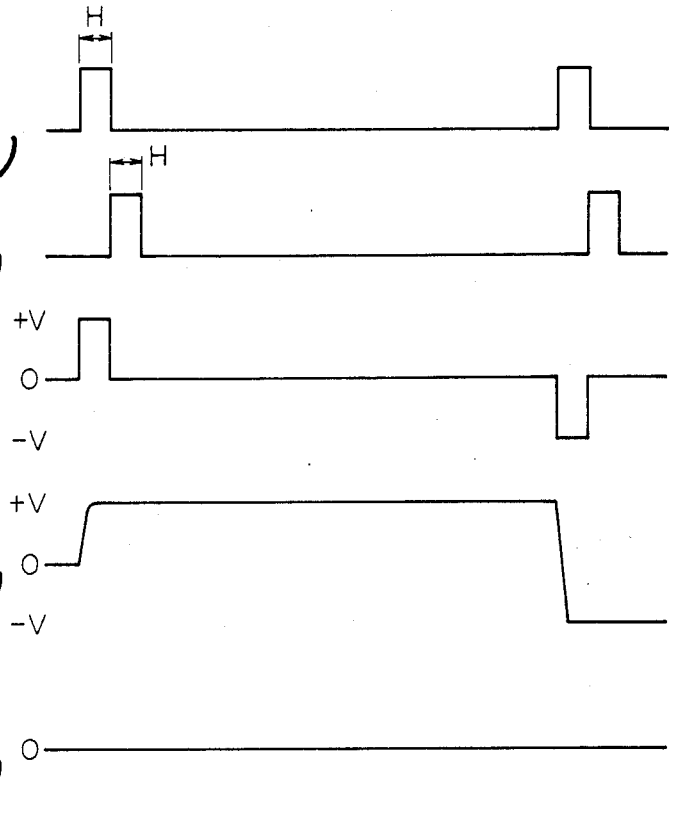
FIG. 4(a)
(PRIOR ART)
FIG. 4(b)
(PRIOR ART)
FIG. 4(c)
(PRIOR ART)
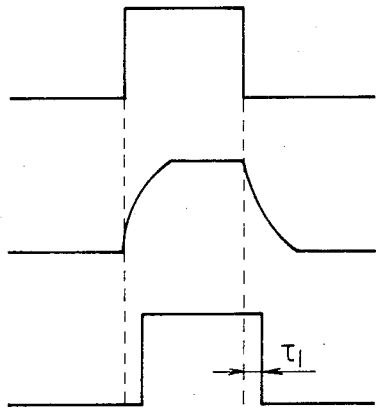

H

+V

0
+V

0
+V
+V1

0
+V2

0
0
+V

0
+V

0
+V3

0

METHOD OF DRIVING LIQUID CRYSTAL DISPLAY DEVICE

BACKGROUND OF THE INVENTION

A. Field of The Invention

This invention relates to matrix type liquid crystal display devices, and more particularly to a method of driving a matrix type liquid crystal display device in which each of the picture elements in the matrix type display pattern is provided with a thin film transistor.

B. Description Of the Prior Art

In a matrix type liquid crystal display with thin film transistors, the thin film transistors are provided in the liquid crystal display panel and the device can produce a high contrast display even when it is driven at a low duty ratio or duty cycle in a multiple-line multiplex driving mode. A generally well-known matrix type liquid crystal display device is shown in FIG. 1. In FIG. 1, thin film transistors 11 are connected to display picture element electrodes 12 via the drain electrodes of the thin film transistors 11. Line electrodes 13 are connected to the gate electrodes 25 of the thin film transistors 11 and column electrodes 14 are connected to the source electrodes 26 of the thin film transistors. Insulating films 15 insulate the line electrodes 13 from the column electrodes 14. These line (row) and column electrodes 13 and 14 are formed between the picture element electrodes 12.

The principles of operation of the above-described liquid crystal display device will be described with reference to an equivalent circuit diagram (FIG. 2) and a drive signal waveform diagram (FIG. 3). The liquid crystal display device described below employs, for example, n-channel type thin film transistors. In the case of p-channel type thin film transistors, the polarity of the scanning signal waveform is inverted. A scanning signal, as illustrated in FIGS. 3(*a*) or 3(*b*), is applied to gate electrodes 25 (FIG. 2) via the line electrode 21 to turn on the transistors 22 for a certain period of time. FIGS. 3(*a*) and 3(*b*) depict the signals which are applied to line electrodes (i) and (i+1), respectively. A data waveform signal, as illustrated in FIG. 3(*c*), is applied to the source electrodes 26 of the thin film transistors 22 (FIG. 2) via the column electrodes 23. The data signal voltage is raised to the value V for the time period necessary to scan a line of liquid crystals to be turned on, and it is returned to zero volts for the time period necessary to scan a line of liquid crystals to be turned off. The polarity of the voltage V changes, every time when a scanning signal is applied to the gate electrode when an AC type driving waveform is employed. FIG. 3(*c*) illustrates such a signal as applied to column electrode (j), and, in this case, the picture element at the intersection of column (i) and line (j) is turned on, while the picture elements connected to the other line remain off. In FIG. 2, the liquid crystals have capacitances 24 between the display picture element electrode 12, connected to the drain electrode 27 of the thin film transistor, and the counter electrode held at zero volts.

The picture element at the intersection of line (i) and column (j) will be described with reference to FIG. 2. When the thin film transistor 22 is turned on, a charge is applied to the capacitance 24 of the liquid crystal 12 from the column electrode through the transistor 22, and the potential of the display picture element electrode 12 is raised to +V which is a voltage equal to that of the data signal. When the transistor 22 is turned off, the charge remains on the capacitance 24 of the liquid crystal and the potential of the display picture element electrodes is maintained at +V. When the transistor 22 is turned on again, the capacitance 24 of the liquid crystal is negatively charged until the potential of the display picture element electrode 112 is −V, and the charge on the capacitance 24 is maintained for the period of time during which the transistor is kept nonconductive. Thus, a signal as shown in FIG. 3(*d*) is applied to the display picture element electrode, and the liquid crystal is turned on.

The operation of the picture element at the intersection of line (i+1) and column (j) will be described with respect to the description of the picture element at the intersection of line (i) in column (j). In this case, the operation is the same as the case described above, except that the voltage of the data signal is zero volt. When the display picture element electrode 12 at the intersection of line (i+1) and column (j) is maintained at zero volts, as is shown in FIG. 3(*e*), no voltage is applied to the liquid crystal, and accordingly the liquid crystal remains off.

As is apparent from the above description, during the operation of the above-described liquid crystal display device, even though multiplex driving is carried out, the voltage applied to the liquid crystal is equivlent to a static driving voltage.

In the above-described liquid crystal display device, the line electrodes 13 and column electrodes 14 are a metal such as aluminum or nickel, or a transparent conductive film. Because light cannot pass through the metal, the electrode width should be as small as possible but within a range limited by patterning accuracy and high device yield. In some cases the resistance of each electrode will be high enough so that it cannot be disregarded. Where the line and column electrodes are a transparent conductive film, they have a sheet resistance of 10 Ω/□ even if the transparent conductive film is of the highest quality. Increasing the electrode width to reduce the resistance is undesirable, because an undesirable decrease in the area of the display picture element electrodes results. Therefore, in this case, it is difficult to make the resistances of the line and column electrodes sufficiently small.

If the line electrodes 13 and the column electrodes 14 have such a high resistance as described above, the electrode resistance coupled with the load capacitance 24, connected to the electrodes, and other stray capacitances distort the applied voltagae waveform. For example, when a waveform signal, as depicted in FIG. 4(*a*), is applied to the electrode, it is distorted by the electrode resistance and the capacitance, as illustrated in FIG. 4(*b*). The distorted waveform of FIG. 4(*b*) is equivalent to the original signal (FIG. 4(*a*)) delayed by a time $t_1$ as illustrated in FIG. 4(*c*).

The effect of the delayed waveform on the display when the liquid crystal display device is driven, will be described with reference to FIG. 5. FIGS. 5(*a*) and 5(*b*) depict an original scanning signal and a delayed scanning signal, respectively. When the scanning signal lags behind the data signal, as illustrated in FIGS. 5(*b*) and 5(*c*) during scanning of the picture element at the intersection of line (i) and column (j), the transistor 22 rendered conductive, the capacitance 24 associated therewith is charged to +V volts. However, before the transistor 22 is turned off, the data signal is changed from +V to zero volts and the capacitance 24 thus discharges. Accordingly, the potential of the display picture element electrode 12 when the transistor is turned off becomes smaller than +V, as illustrated in FIG. 5(*e*). This voltage drop is increased in accordance with the length of the delay. In other words, the voltage drop increases as the electrode resistance and capacitance associated with the circuit gets higher. In a case where the display content is such that the picture elements on line (i + 1) are also turned on, no voltage drop occurs. Similarly, the picture element at the intersection of line (i − 1) and column (j) which is to be held at zero volts is charged to a voltage $+V_2$, as illustrated in FIG. 5(*f*). When the timing of the scanning signal is delayed by the electrode resistance and capacitance, as described above, the voltage applied to each picture element changes according to or is dependent on the display content. Since the magnitude of the change depends on the positions in the display which are turned on, the display contrast is not uniform.

Now, let us consider the case where the data signal lags behind the scanning signal with reference to FIGS. 5(*a*) and 5(*d*). In this case, the picture element at the intersection of line (i) and column (j), is charged to zero volts, which is the data intended for line (i − 1), when the transistors is turned on and then to +V the data intended for line (i) and column (j). If, in this case, the driving condition permits quick charging through the transistor 22, then no problems will arise, and picture element electrode is charged to +V, as illlustrated in FIG. 5(*g*). Howevaer, when the charging period is longer than the scanning period H, the picture element, which should be charged to +V, as illustrated in FIG. 5(*h*), is chargaed only to an intermediate level $+V_3$, as shown in FIG. 6(*i*), and therefore the display contrast is once again not uniform.

SUMMARY OF THE INVENTION

In view of the above-described difficulties accompanying the conventional method of driving a matrix type liquid crystal display device, an object of this invention is to provide a method of driving a liquid crystal display device in which the display contrast is satisfactory even when the drive signal waveform is distorted by the resistances and capacitances of the line, column and display electrodes.

A further object of this invetion is to provide a method of driving a liquid crystal display device in which the display contrast is satisfactory even when the distortion of the drive signal waveform caused by the resistances and capacitances of the line, column and display electrodes causes either the data signal to lag behind the scanning signal or the scaning signal to lag behind the data signal.

These and other objects of the present invention can be accmplished by a method of driving a matrix type liquid crystal display wherein the scanning signal is advanced with respect to the data signal by a maximum time determined by the duration of the data signal.

These together with other objects and advantages which will be subsequently apparent, reside in the details of construction and operation as are more fully hereinafter described and claimed, reference being had to the accompanying drawings forming a part hereof, wherein like numerals refer to like parts throughout.

BRIEF DESCRIPTION OF THE DRAWINGS

FIG. 3, including FIGS. 3(*a*)–3(*e*), is a waveform diagram associated with the conventional driving method depicting the signal supplied to the electrodes of a matrix type liquid crystal;

FIG. 4, including FIGS. 4(*a*)–4(*c*), is a waveform diagram illustrating the distortion of the signal waveform caused by the resistances and capacitances of the line and column electrodes when a conventional driving method is used;

DESCRIPTION OF THE PREFERRED EMBODIMENT

Figure 1:
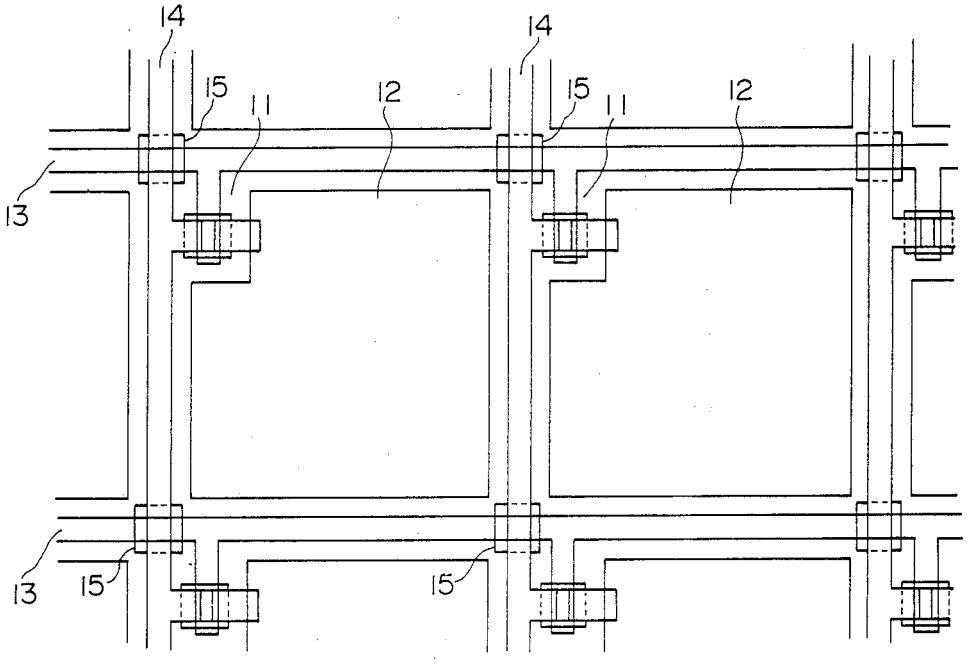
FIG. 1 (PRIOR ART)
FIG. 1 is a plan view of a matrix type liquid crystal display device including thin film transistors.
Figure 2:
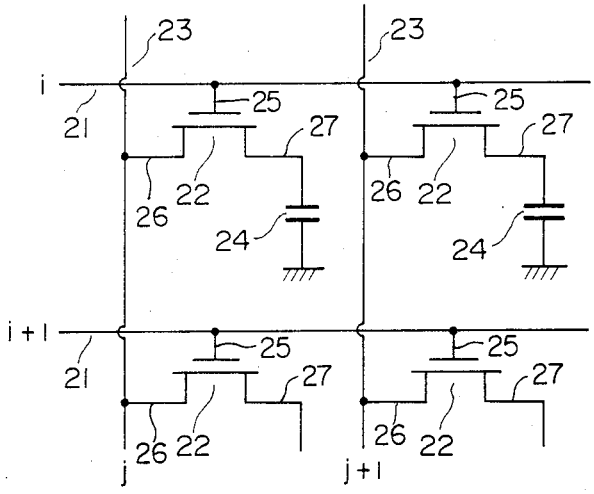
FIG. 2 (PRIOR ART)
FIG. 2 is an equivalent circuit diagram corresponding to the device in FIG. 1.
Figures 5A, 5B, 5C, 5D, 5E, 5F, 5G, 5H, 5I:
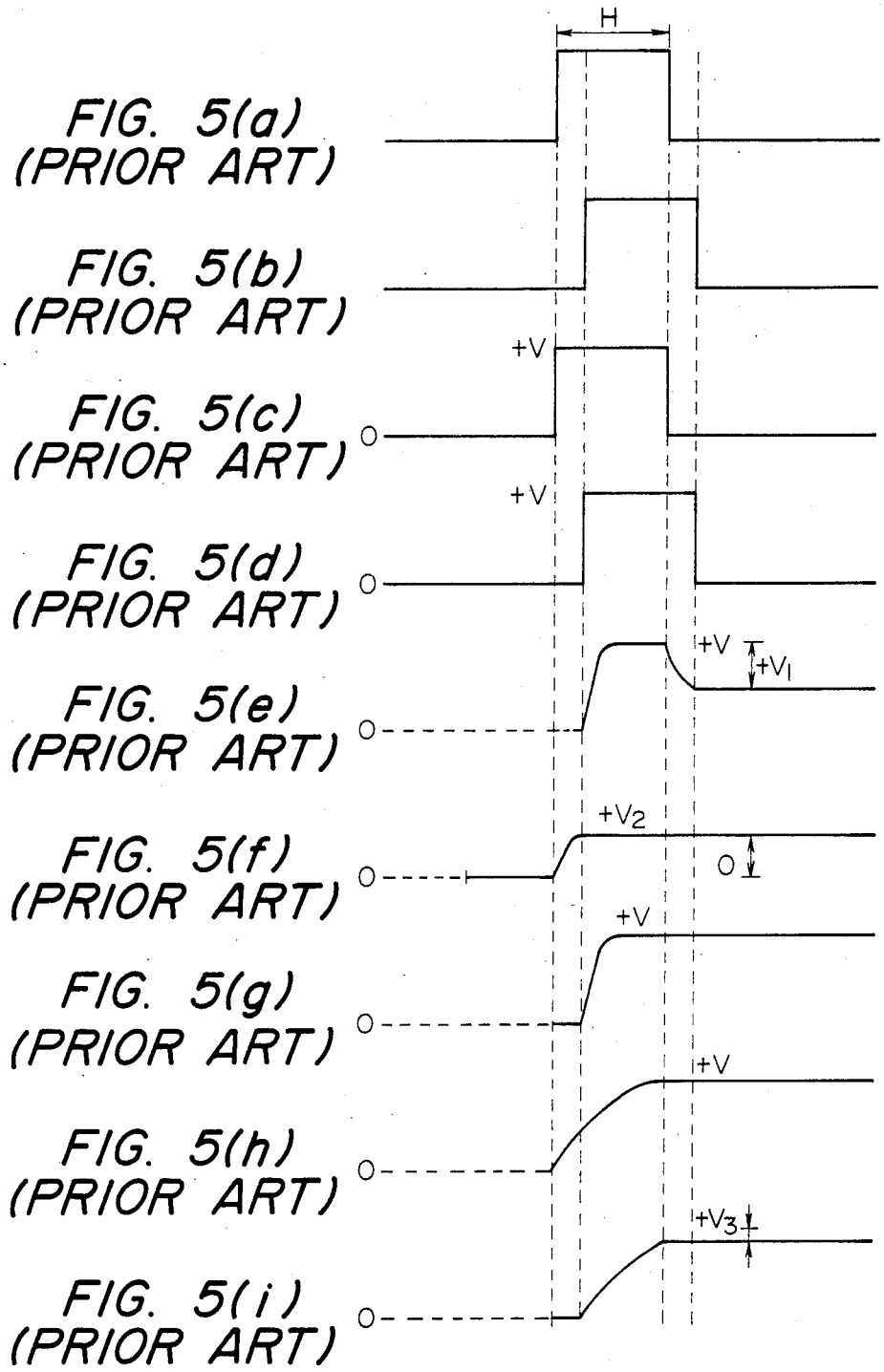
FIG. 5(a) (PRIOR ART)
FIG. 5(b) (PRIOR ART)
FIG. 5(c) (PRIOR ART)
FIG. 5(d) (PRIOR ART)
FIG. 5(e) (PRIOR ART)
FIG. 5(f) (PRIOR ART)
FIG. 5(g) (PRIOR ART)
FIG. 5(h) (PRIOR ART)
FIG. 5(i) (PRIOR ART)
FIG. 5, including FIGS. 5(*a*)–5(*i*), is a waveform diagram illustrating the shift in the signals supplied to the electrodes of a matrix type liquid crystal display device when the waveform distortion associated with the conventional driving method is taken into account.
Figures 6A, 6B, 6C:
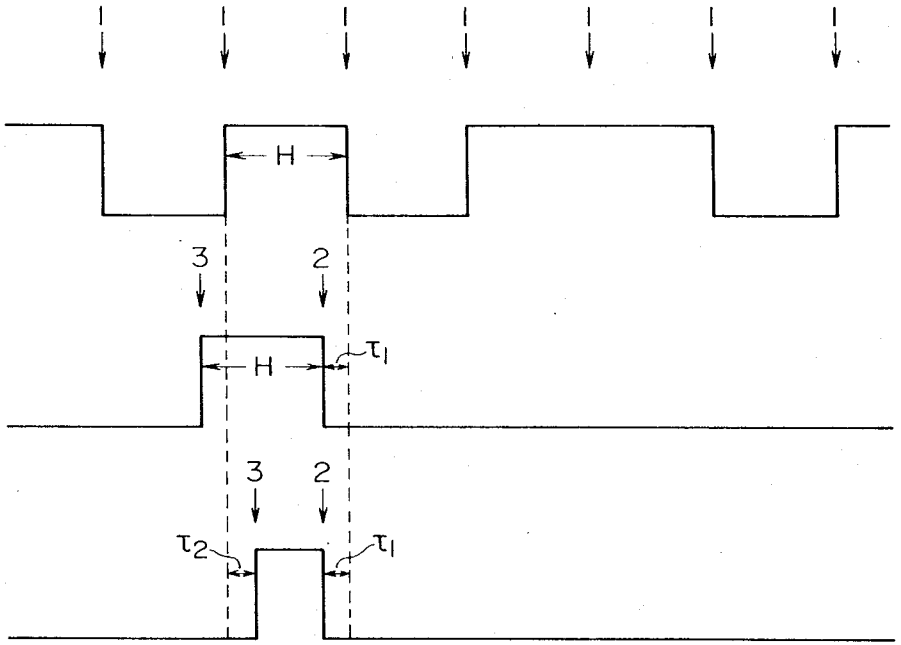
FIG. 6, including FIGS. 6(*a*)–6(*c*) is a waveform diagram of the signals supplied to the electrodes of a matrix type liquid crystal device according to an embodiment of the present invention.

The driving method according to the present invention advances the timing of the scanning signal pulse with respect to the timing of the data signal pulse, to eliminate the effect caused by the delay of the waveform. The driving waveforms are as illustrated in FIG. 6, where FIG. 6(*a*) dipicts a data signal which is applied to column electrodes, having switching intervals H, the data is charged at time 1 and where FIGS. 6(*b*) and 6(*c*) depict scanning signal waveforms of the driving method of the present invention. In FIG. 6(*b*) the scanning signal waveform in the transistor 22 turns off at time 2 which occurs earlier than the switching time 1 of the data signal (FIG. 6(*a*)). The amount of change is determined by the maximum delay time $\tau_1$ which can be estimated from the time constant of the combined resistance and capacitance of the line electrodes. In the scanning signal waveform (FIG. 3(*b*)), the leading edge time 3, at which the transistor is turned on, is not particularly limited when the capacitance 24 be charged through the transistor 22 quickly, and therefore, the interval between times 2 and 3 can be set to a maximum value H which is determined from the number of scanning lines. The data switching intervals and the scanning intervals are equal while the scanning signal leading edge (FIG. 6(*b*)) occurs earlier, by $\tau_1$, than the data switching time (FIG. 6(*a*)).

When the charging of the capacitance 24 occurs slowly and the delay of the data signal waveform with respect to the scanning signal waveform causes a non-uniform display problem, the switching timing 1 of the data signal by an expected delay time $\tau_2$, as illustrated in FIG. 6(*c*), and the effect caused by the delay of the data signal waveform can be eliminated.

Figure 7A:
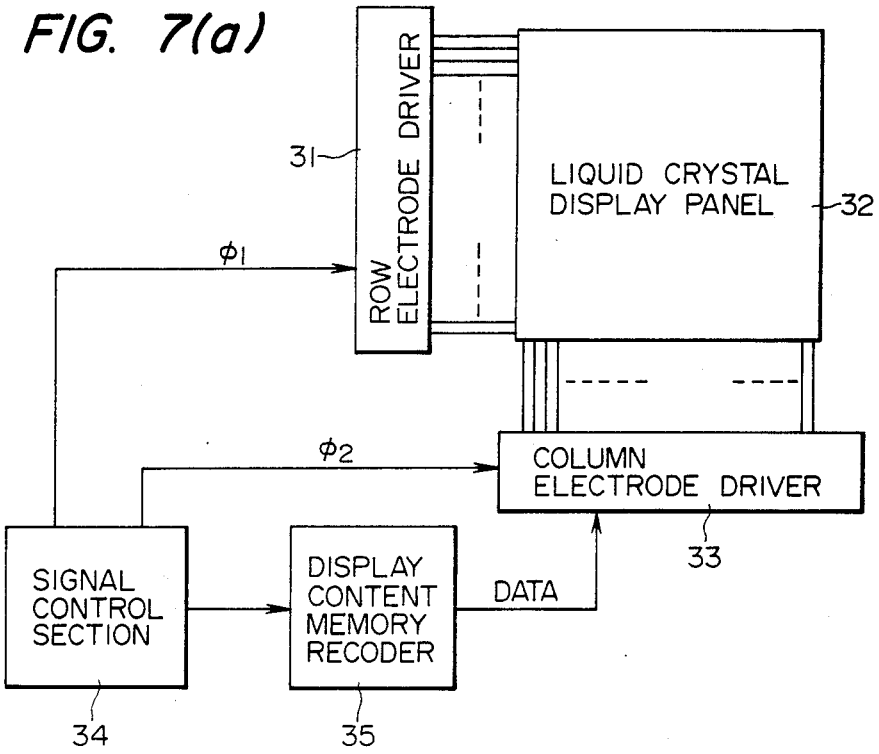
FIG. 7, including FIGS. 7(*a*)–(*c*), and 8, including FIGS. 8(*a*)–8(*c*), are block diagrams and waveform diagram illustrating examples of the driving circuitry and the waveforms associated therewith according to the present invention.
Figure 7B:
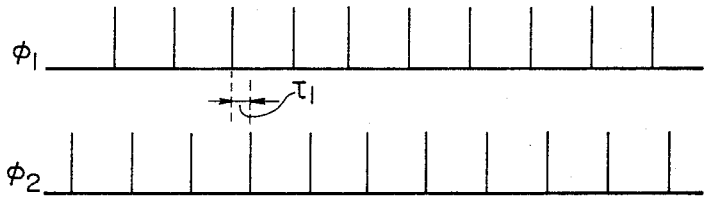
Figure 7C:
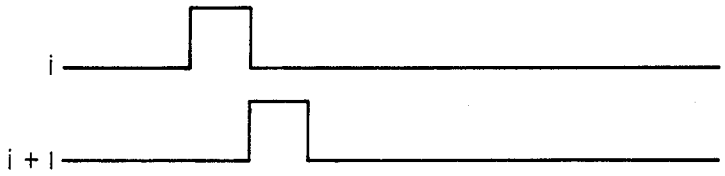

FIG. 7(*a*) is a block diagram of a drive circuit using the scanning waveforms of FIG. 6(*b*) according to the principle described above. FIGS. 7(*b*) and 7(*c*) are waveform diagrams for a description of the operation of FIG. 7(*a*). In FIG. 7(*a*), a liquid crystal panel having line electrodes and column electrodes form an electrode matrix, and thin film transistors are provided at the intersection of the line and column electrodes. Suitable thin film transistors can be found in Japanese Patent Application No. 230,979 by Takechi et al. filed on Dec. 29, 1982 and the corresponding U.S. Ser. No. 566,882 filed concurrently herewith, where both applications are assigned to the assignee of this application. The line electrodes and the column electrodes are connected to electrode drivers 31 and 33 respectively, so that the drive voltages are applied to the proper electrodes. The line electrode driver 31 comprises a standard shift register with a number of stages equal to the number of scanning lines. In the line electrode driver 31, the scanning waveform is shifted by a clock pulse $\phi_1$ and applied to the line electrodes. The column electrode driver 33 comprises a standard shift register and standard latch circuits. In the column electrode driver 33 data is latched with the aid of a clock pulse $\phi_2$ and applied to the column electrodes.

A signal control section 34 outputs the clock pulses $\phi_1$ and $\phi_2$, and applies a data signal through a display content memory/decoder 35 to the column electrode driver 33. The above-described circuit is substantially the same as conventional drive circuits, however, the timing of the clock pulse $\phi_1$ and the timing of the clock pulse $\phi_2$ ($\phi_2$ being the same in the prior art) are shifted as much as $\tau_1$ with respect to each other, as shown in FIG. 7(*b*), resulting in a driving method in which the scanning waveform leads the data waveform by $\tau_1$. FIG. 7(*c*) illustrates scanning waveforms for the line electrodes (i) and (i+1).

Figure 8A:
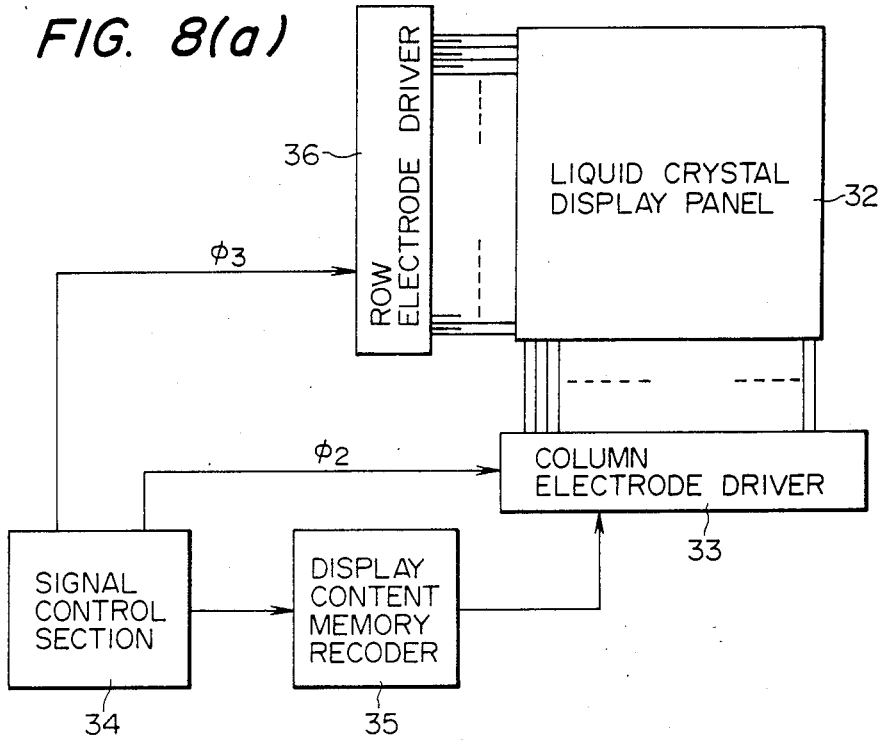
Figure 8B:
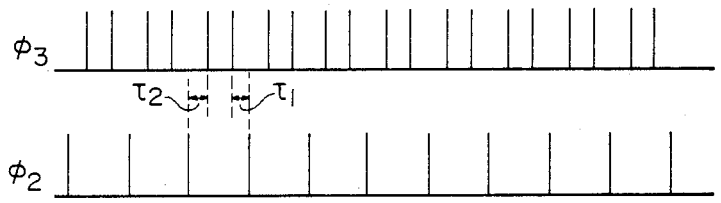
Figure 8C:
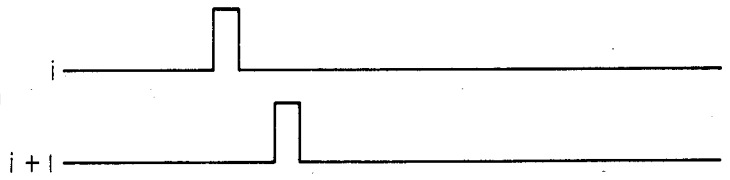

FIG. 8(*a*) is a block diagram of a drive circuit using the scanning waveform of FIG. 6(*c*), and FIGS. 8(*b*) and 8(*c*) are waveform diagrams for a description of the operation. The drive circuit is different from the drive circuit in FIG. 7 because the circuit in FIG. 8(*a*) uses a different electrode line driver 36. The line electrode driver 36 comprises a shift register which has twice as many stages as scanning lines. In the line electrode driver 36, the scanning waveform which is shifted by clock pulse $\phi_3$ is applied to the line electrodes from every other stage. Accordingly, the frequency of the clock pulse $\phi_3$ is twice that of the clock pulse $\phi_1$ or $\phi_2$, and its timing is as illustrated in FIG. 8(*b*). FIG. 8(*c*) illustrates the scanning signal waveforms for line electrodes (i) and (i+1) in which the switching timing of the scanning signal is delayed with respect to the switching timing of the data signal, and the trailing edge of the scanning signal is advanced with respect to the trailing edge of the data signal. With the above-described drive circuit, the drive method as described with reference to FIG. 6(*c*) can be performed by controlling the timing of the clock pulse $\phi_3$.

As is apparent from the above description, the invention provides an effective driving method which eliminates the effects caused by distortion of the signal waveform which in turn is caused by the resistances and capacitances of the electrodes. The method is very useful for driving a large capacity X-Y matrix type liquid crystal display device.

The many features and advantages of the invention are apparent from the detailed specification and thus it is intended by the appended claims to cover all such features and advantages of the method which fall within the true spirit and scope of the invention. Further since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of driving a matrix type liquid crystal display device including a liquid crystal picture forming element at the intersection of each line electrode and column electrode and where each liquid crystal element is provided with a thin film transistor connected to the row electrode and the column electrode, comprising the steps of:

(a) applying a scanning signal pulse to the line electrode; and (b) applying a data signal pulse to the column electrode where the scanning signal pulse is advanced in time with respect to the data signal pulse, the advancement in time of the scanning signal pulse being determined in accordance with a resistor-capacitor time constant associated with a capacitance formed by the liquid crystal element and the line electrode and a resistance of the line electrode.

2. A method as recited in claim 1, wherein a trailing edge timing of the scanning signal pulse is advanced in time with respect to the data signal pulse.

3. A method as described in claim 2, wherein a pulse width of the scanning signal pulse is equal to a data switching interval between consecutive data signal pulses.

4. A method as recited in claim 2, wherein a leading edge timing of the scanning signal pulse is delayed in time with respect to a switching timing of the data signal pulse.

5. A method as recited in claim 1, wherein the advancement of the scanning signal pulse is determined in accordance with a resistor-capacitor time constant associated with a capacitance formed by the liquid crystal element and the line electrode and a resistance of the line electrode.

6. A method of driving a matrix type liquid crystal display device including a liquid crystal picture forming element at the intersection of each line electrode and column electrode and where each liquid crystal element is provided with a thin film transistor connected to the line electrode and the column electrode, comprising the steps of:

(a) applying a scanning signal pulse having a leading edge and a trailing edge to the line electrode; and (b) applying a data signal pulse to the column electrode, where the switching timing of the scanning signal pulse is delayed in time with respect to the leading edge timing of the data signal pulse, the delay in timing being determined in accordance with a resistor-capacitor time constant associated with a capacitance formed by the liquid crystal element and the line electrode and a resistance of the line electrode.

7. A method as recited in claim 6, wherein the scanning signal pulse trailing edge timing is advanced in time with respect to the switching timing of the data signal pulse.

8. A method as recited in claim 6, wherein the advancement of scanning signal pulse trailing edge timing is determined in accordance with a resistor-capacitor time constant associated with a capacitance formed by the liquid crystal element and the line electrode and a resistance of the line electrode.

9. A method as recited in claim 6, wherein the advancement of the scanning signal pulse trailing edge timing is determined in accordance with a charging rate associated with a capacitance formed by the liquid crystal element.

10. A method as recited in claim 6, wherein the delay of the scanning signal pulse leading edge timing is determined in accordance with a resistor-capacitor time constant associated with a capacitance formed by the liquid crystal element and the line electrode and a resistance of the line electrode and a rate of charging associated with a capacitance formed by the liquid crystal element and a resistance of the thin film transistor.

* * * * *

UNITED STATES PATENT AND TRADEMARK OFFICE

CERTIFICATE OF CORRECTION

PATENT NO. : 4,649,383

DATED : March 10, 1987

INVENTOR(S) : Makoto Takeda, Keisaku Nonomura and Fumiaki Funada

It is certified that error appears in the above-identified patent and that said Letters Patent is hereby corrected as shown below:

Column 2, line 6, "112" should be --12--.

Column 3, line 30, "Howevaer" should be --However--;
line 33, "chargaed" should be --charged--;
line 46, "invetion" should be --invention--;
line 55, "accmplished" should be --accomplished--.

Column 4, line 23, "diagram" should be --diagrams--;
line 34, "dipicts" should be --depicts--.

Signed and Sealed this

Twenty-fifth Day of August, 1987

*Attest:*

DONALD J. QUIGG

*Attesting Officer*

*Commissioner of Patents and Trademarks*